US006375751B2

(12) United States Patent
Reisig et al.

(10) Patent No.: US 6,375,751 B2
(45) **Date of Patent: *Apr. 23, 2002**

(54) PROCESS FOR PRODUCTION OF PURIFIED CANE JUICE FOR SUGAR MANUFACTURE

(75) Inventors: Richard C. Reisig, Scottsbluff, NE (US); Michael Donovan, Great Dunmow (GB)

(73) Assignees: Tate & Lyle, Inc., Decatur, IL (US); Tate & Lyle Industries, Limited, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,241

(22) Filed: Aug. 19, 1999

(51) Int. Cl.[7] ..... C13D 3/16; C13D 3/10
(52) U.S. Cl. ..... 127/55; 127/48; 127/52
(58) Field of Search ..... 127/54, 55, 48, 127/52

(56) References Cited

U.S. PATENT DOCUMENTS

| | | | | |
|---|---|---|---|---|
| 1,578,463 | A | 3/1926 | Nicholson et al. | |
| 1,815,276 | A | 7/1931 | Schwieger | |
| 2,164,186 | A | 6/1939 | Brown et al. | 127/50 |
| 2,557,800 | A | 6/1951 | Seailles | 127/52 |
| 2,697,049 | A | 12/1954 | Brieghel-Müller | 127/50 |
| 2,801,940 | A | 8/1957 | Stark et al. | 127/44 |
| 2,824,028 | A | 2/1958 | Zenzes | 127/50 |
| 2,977,253 | A | 3/1961 | Grandadam | 127/50 |
| 3,113,044 | A | 12/1963 | Alston | 127/48 |
| 3,168,419 | A | 2/1965 | Gale | 127/50 |
| 3,926,662 | A | 12/1975 | Rundell et al. | 127/48 |
| 4,057,437 | A | 11/1977 | Kracklauer | 127/9 |
| 4,115,147 | A | 9/1978 | Shimizu et al. | 127/54 |
| 4,328,043 | A | 5/1982 | Freytag et al. | 127/44 |

(List continued on next page.)

FOREIGN PATENT DOCUMENTS

| | | |
|---|---|---|
| EP | 0 126 512 | 11/1984 |
| EP | 0 655 507 | 5/1995 |
| GB | 477 312 | 12/1937 |
| GB | 1 361 674 | 7/1974 |
| WO | WO92/08810 | 5/1992 |

OTHER PUBLICATIONS

Nielsen et al., "Prospects and Possibilities in Application of Membrane Filtration Systems Within the Beet and Cane Sugar Industry," *Sugar Technology Reviews* 9:59–117 (1982) no month provided.

(List continued on next page.)

*Primary Examiner*—David Brunsman
(74) *Attorney, Agent, or Firm*—Williams, Morgan & Amerson, P.C.

(57) ABSTRACT

The present invention relates to a process for producing sugar from cane that includes the steps of: (a) grinding sugar cane or pieces thereof into pulp; (b) mechanically separating juice from the pulp; and (c) membrane filtering the separated juice, for example through a ultrafiltration membrane, producing a retentate and a permeate. Preferably in step (a), the cane is cut into pieces having an average fiber length of less than 10 millimeters, more preferably into pieces having an average fiber length of less than 5 mm with a fiber diameter of about 200 microns or less. The mechanical separation of juice from cane pieces can be done suitably by filtration or centrifugation. It is preferred to adjust the pH of the separated juice to at least about 7 prior to membrane filtration, more preferably to at least about 7.5, for example by adding lime or sodium hydroxide. The permeate can be evaporated and crystallized by conventional means to produce white sugar. The mother liquor from this first crystallization can be crystallized further, usually twice more and the sugar obtained can either be used directly as a product, or remelted with the feed to the first crystallization. The remaining mother liquor is molasses.

13 Claims, 1 Drawing Sheet

U.S. PATENT DOCUMENTS

| | | | | | |
|---|---|---|---|---|---|
| 4,332,622 | A | | 6/1982 | Hohnerlein, Jr. | 127/41 |
| 4,432,806 | A | | 2/1984 | Madsen et al. | 127/48 |
| 4,478,645 | A | | 10/1984 | Gudnason | 127/57 |
| 4,702,839 | A | | 10/1987 | Koerts et al. | 210/638 |
| 4,716,044 | A | | 12/1987 | Thomas et al. | 426/51 |
| 4,795,494 | A | | 1/1989 | Toth et al. | 127/48 |
| 5,145,584 | A | | 9/1992 | Swamikannu | 210/650 |
| 5,281,279 | A | | 1/1994 | Gil et al. | 127/46.1 |
| 5,320,681 | A | | 6/1994 | Moe et al. | 127/46.1 |
| 5,466,294 | A | | 11/1995 | Kearney et al. | 127/42 |
| 5,468,300 | A | | 11/1995 | Monclin | 127/43 |
| 5,468,301 | A | | 11/1995 | Monclin | 127/43 |
| 5,480,490 | A | | 1/1996 | Toth et al. | 127/42 |
| 5,554,227 | A | | 9/1996 | Kwok et al. | 127/58 |
| 5,685,990 | A | | 11/1997 | Saugmann et al. | 210/650 |
| 5,759,283 | A | | 6/1998 | Ekern et al. | 127/42 |
| 5,865,899 | A | * | 2/1999 | Theoleyre et al. | 127/42 |
| 5,902,408 | A | | 5/1999 | Player et al. | 127/30 |
| 5,902,409 | A | | 5/1999 | Kwok et al. | 127/58 |
| 6,096,136 | A | * | 8/2000 | Saska | 127/42 |

OTHER PUBLICATIONS

Kishihara et al., "Improvement of Flux in Ultrafiltration of Cane Juice," *Int. Sugar Jnl.* 85:99–102 (1983) no month provided.

Hanssens et al., "Ultrafiltration as an Alternative for Raw Juice Purification in the Beet Sugar Industry" (17$^{th}$ General Assembly of C.I.T.S., Copenhagen 1983) no month provided.

"Membrane Filtration," *Food Engineering* (Nov. 1987).

"Purification Using Membrane Filtration," *Sugar Journal* (Nov. 1994).

Abram et al., "Sugar Refining: Present Technology and Future Developments," *Sugar: Science and Technology*, Chapter 3, pp. 49–95 (1979) no month provided.

Kort, "Colour in the Sugar Industry," *Sugar: Science and Technology*, Chapter 4, pp. 97–130 (1979) no month provided.

Reinefeld, "Progress in the Technology of Beet–Sugar," *Sugar: Science and Technology*, Chapter 5, pp. 131–149 (1979) no month provided.

Chen, "Outline of Process for Manufacturing Raw Cane Sugar," *Cane Sugar Handbook*, Chapter 2, pp. 47–105, 127–186 and 526–559 (1985) no month provided.

Lancrenon et al., "Mineral Membranes for the Sugar Industry," *Sugar y Azucar*, pp. 40–45 (1993) no month provided.

Hartmann, "Lime and Carbon Dioxide Production," *Beet–Sugar Technology*, Chapter XVII, pp. 567–593 (1982) no month provided.

Toth, "The Wescot Juice Purification System" (1989 ASSBT Meeting, New Orleans, Louisiana, Feb. 26(Mar. 2, 1989).

"Beet Sugar Process," Western Sugar, no date provided.

Derwent Abstract, DD 136455 (1979) no month provided.

Derwent Abstract, DE 3229345 (1984) no month provided.

Derwent Abstract, EP 635578 (1995) no month provided.

Derwent Abstract, EP 655507 (1995) no month provided.

Derwent Abstract, RU 2016637 (1994) no month provided.

Derwent Abstract, JP 5004929 (1993) no month provided.

Derwent Abstract, JP 6287199 (1994) no month provided.

Derwent Abstract, SU 1669984 (1991) no month provided.

Derwent Abstract, NL 8800175 (1989) no month provided.

Derwent Abstract, FR 2586360 (1987) no month provided.

Derwent Abstract, US 4999116 (1991) no month provided.

Derwent Abstract, RU 2016637 (1994) no month provided.

Derwent Abstract, JP 5004929 (1993) no month provided.

Derwent Abstract, DE 3229345 (1984) no month provided.

Derwent Abstract, US 5008254 (1991) no month provided.

Derwent Abstract, JP 6287199 (1994) no month provided.

Derwent Abstract, SU 1756817 (1992) no month provided.

Derwent Abstract, SU 1669984 (1991) no month provided.

Derwent Abstract, WO 9208810 (1992) no month provided.

Derwent Abstract, NL 8800175 (1989) no month provided.

Derwent Abstract, FR 2586360 (1987) no month provided.

Derwent Abstract, DE 3229345 (1984) no month provided.

Derwent Abstract, DD 136455 (1979) no month provided.

* cited by examiner

PROCESS FOR PRODUCTION OF PURIFIED CANE JUICE FOR SUGAR MANUFACTURE

BACKGROUND OF THE INVENTION

The present invention relates to a process for producing sucrose from sugar cane.

The production of cane sugar for human consumption generally comprises two distinct operations, namely the production of raw sugar and the production of refined sugar, which are often carried out in separate locations. Production of raw sugar typically takes place at a sugar mill, which is usually located in or near sugar cane fields. In the mill, sugar cane stalks are chopped or shredded into pieces and the pieces are crushed in a series of mills in order to remove the juice. The juice from the first set of roller mills is referred to as "first juice," while the total juice from all the roller mills in the process is referred to as "mixed juice." The juice is normally limed, deaerated and clarified (i.e., removal of suspended solids, usually by sedimentation). The clarified stream is referred to as "clarified juice." The juice is then evaporated to a thick syrup (known as "evaporated juice"), and crystallized in a vacuum pan. The "massecuite" (i.e., mixture of sugar syrup and crystals) produced in the vacuum pan is stirred in a crystallizer, and the mother syrup is spun off from the raw sugar crystals in a centrifugal separator. The solid sugar in the centrifugal basket is washed with water to remove remaining syrup. The solid crystalline product is termed "raw sugar." The mother liquor is then crystallized a further two times to obtain a greater yield of sugar, and the mother liquor is molasses, which can be sold for fermentation or as an animal feed.

Depending on the exact nature of the process steps and conditions used in the sugar mill, the raw sugar product can be made more or less pure. A more highly purified mill product is sometimes referred to as "Mill White" or "Plantation White" sugar. The production of these sugars requires sulphitation, before or after clarification, using $SO_2$ gas. It usually requires a second clarification step, usually at the syrup stage and sometimes a second sulphitation step. In nearly all cases the ash content of this sugar is much higher, perhaps by more than four times, than that of refined white sugar. Although these particular mill products can be sold for human consumption without further processing in some instances, generally raw sugar must be further refined before it reaches a commercially acceptable level of purity, particularly for subsequent use by food and drink manufacturers.

Therefore, the raw sugar from a mill is usually transported to a sugar refinery for further processing. In a conventional cane sugar refining process, the raw sugar is first washed and centrifuged to remove adherent syrup, and the "affined sugar" thus produced is dissolved in water as "melter liquor." The syrup removed from the surface of the raw sugar is known as "affination syrup" and is broadly similar in composition to the mother syrup from the raw sugar crystallization. The affination syrup is processed through vacuum pans, crystallizers and centrifugal separators similar to those used for the production of raw sugar, to recover an impure crystalline sugar product which has approximately the same composition as raw sugar. This recovered sugar product is dissolved in water, along with the affined raw sugar, to make melter liquor. Thus, the treatment of affination syrup in the recovery house of the refinery is somewhat similar to the production of raw sugar from evaporated juice.

The melter liquor is then purified, generally by the successive steps of clarification (also referred to as "defecation") and decolorization, and the resulting "fine liquor" is crystallized to give refined sugar. The clarification step usually involves forming an inorganic precipitate in the liquor, and removing the precipitate and along with it insoluble and colloidal impurities which were present in the melter liquor. In one of the clarification processes commonly used for melter liquor, termed "phosphatation," the inorganic precipitate is calcium phosphate, normally formed by the addition of lime and phosphoric acid to the liquor. The calcium phosphate precipitate is usually removed from the liquor by flotation, in association with air bubbles. Other clarification processes, termed carbonation (or carbonatation) processes, involve adding lime and carbon dioxide to the liquor, and produce calcium carbonate precipitate. This is removed by filtration, usually under pressure.

The geographical separation of cane sugar milling and refining operations is a common feature of the industry. It is not practical to build a refinery at the site of every cane sugar mill, due to the relatively large capital cost of conventional refining process equipment.

The juice produced in a cane sugar mill typically has a color of about 14,000 icu, and conventional mill technology can process this to raw sugar with a whole color of 2000 to 5000 icu, and a well affined color of 400–800 icu. It is very difficult to produce white sugar of less than 80 icu in one crystallization in a mill because of the extremely high colors of the starting material, and because it is difficult to filter cane juice or syrup. After a crystallization at the mill, a significant portion of colored materials are concentrated in the raw sugar crystals, and when the raw sugar is refined a high degree of decolorization is required in order to produce white sugar.

One process that has been used in an attempt to overcome this problem is referred to as the Java process. A juice stream in a cane sugar mill is treated with an excess of lime, usually at least equal to about 10% by weight of the sugar in the juice. Excess lime is removed with carbon dioxide. This process evolved into the deHaan process, which used milk of lime and carbonation, at 55° C. The deHaan process used multiple incremental additions of milk of lime followed by carbonation. These processes did improve the color of the crystallized sugar product from the mill, but the very large amount of lime required in order to achieve good filtration made the processes economically undesirable, as well as needing a large amount of filtration equipment, and producing a large amount of material that would need to be disposed of, giving environmental problems.

Attempts have been made in the past to incorporate membrane filtration into the A processing of cane sugar. However, such attempts have generally used membrane filtration as supplement to conventional clarification steps using lime. Therefore, the equipment cost of such proposed processes has tended to be relatively high.

In addition, the roller mills used in cane processing are very large and expensive, and typically require frequent maintenance. A cane sugar process that wholly or partially eliminates the need for such equipment could offer substantial cost savings.

There is a need for improved cane sugar processes that would allow production of a highly purified product using fewer crystallizations, and preferably in a single plant, rather than in separate sugar mills and refineries, in order to reduce the cost and simplify the processing of cane sugar for human consumption.

SUMMARY OF THE INVENTION

The present invention relates to a process for producing sugar from cane that includes the steps of: (a) grinding sugar cane or pieces thereof into pulp; (b) mechanically separating juice from the pulp; and (c) membrane filtering the separated juice, producing a retentate and a permeate. In step (a), the cane is ground into pulp comprising particles having an average fiber length of considerably less than twenty millimeters, preferably less than about ten millimeters, most preferably less than about 5 mm. The average fiber diameter will be less than about 500 microns and preferably less than about 200 microns. Sugar cane consists of a hard fibrous rind which surrounds a softer pith. When milled the rind forms long fibers whereas the pith tends to be broken down in size more easily. Grinding to a small size allows more complete extraction of sucrose from the bagasse, increasing extraction and the yield of the factory. The sugar produced by this process is white or low color sugar (e.g., a color no greater than about 35 icu).

The mechanical separation of juice from cane pieces can be done, for example, by filtration or centrifugation. It is preferred that water be added to the cane pieces during or prior to centrifugation, either as pure water or as juice that also contains some sucrose.

In addition it is preferred to adjust the pH of the separated juice to at least about 7 prior to membrane filtration, more preferably to at least about 7.5. This pH adjustment can be achieved by adding various agents, but lime or sodium hydroxide are especially preferred. Optionally the separated juice also can be contacted with an agent selected from the group consisting of sulfur dioxide, sulfite salts, bisulfite salts, and mixtures thereof.

A variety of membrane types and filtration conditions can be used. Microfiltration, ultrafiltration, and nanofiltration membranes are examples of types of membranes that are suitable for use in this process.

Grinding the cane to pieces with a fiber length preferably less than about 10 mm, most preferably less than about 5 mm, and a fiber diameter of about 200 microns or less can allow the release of more impurities than in conventional milling. Often these impurities can interfere with subsequent purification, and make the extraction of sucrose by crystallization difficult. The use of a membrane allows removal of many of these impurities, allowing more straightforward processing to white sugar.

After the membrane filtration, the permeate can be concentrated and sucrose crystallized therefrom. Although additional purification steps can be used between the membrane filtration and the concentration/evaporation, in one embodiment of the process no further purification of the permeate occurs after membrane filtration and prior to crystallization. It is particularly preferred that the juice or the permeate is not subjected to carbonation, which involves the addition of lime and carbon dioxide.

One specific embodiment of the invention is a process that includes the steps of: (a) grinding sugar cane or pieces thereof into pulp that comprises particles having an average length of less than about 5 mm and an average diameter of about 200 microns or less; (b) adding water to the pulp; (c) mechanically separating juice from the pulp; (d) adjusting the pH of the juice to at least about 7.0; (e) membrane filtering the juice through a membrane having a molecular weight cutoff between about 1,000–10,000, producing a retentate and a permeate; and (f) concentrating the permeate and crystallizing sucrose therefrom. Carbonation of the juice or the permeate is not carried out in this embodiment of the invention.

Sugar produced in accordance with the present invention is low in ash (considerably lower than plantation white sugar), low in polysaccharides and other floc-forming impurities, and can meet a refined white sugar specification.

The process of the present invention has many advantages over the conventional cane sugar processes that use liming and carbonation. For instance, this process can achieve a higher extraction of sucrose than prior processes. Grinding the cane to a greater degree improves the ease of extraction of sugar from the cane, as it difflises more easily from the finely ground particles.

Another advantage is the reduction in required process steps and equipment. The process of the present invention can produce white sugar directly at a cane mill without the need for refining at a separate facility. Alternatively, the process can produce raw sugar that has very low color and thus requires less equipment and fewer processing stages in the refinery.

The short residence time of the process combined with heating to a lower temperature eliminates the production of materials such as extra color and gelatinized starch that make subsequent purification by the conventional process more difficult. The process eliminates the extensive use of lime, and the disposal of carbonate cake resulting in a drastic reduction of waste products that cause environmental pollution. The conventional process produces a filter cake that comprises products of the liming process and impurities removed from the juice. The proposed process completely eliminates the need for disposal of such materials.

DETAILED DESCRIPTION OF SPECIFIC EMBODIMENTS

Figure 1:
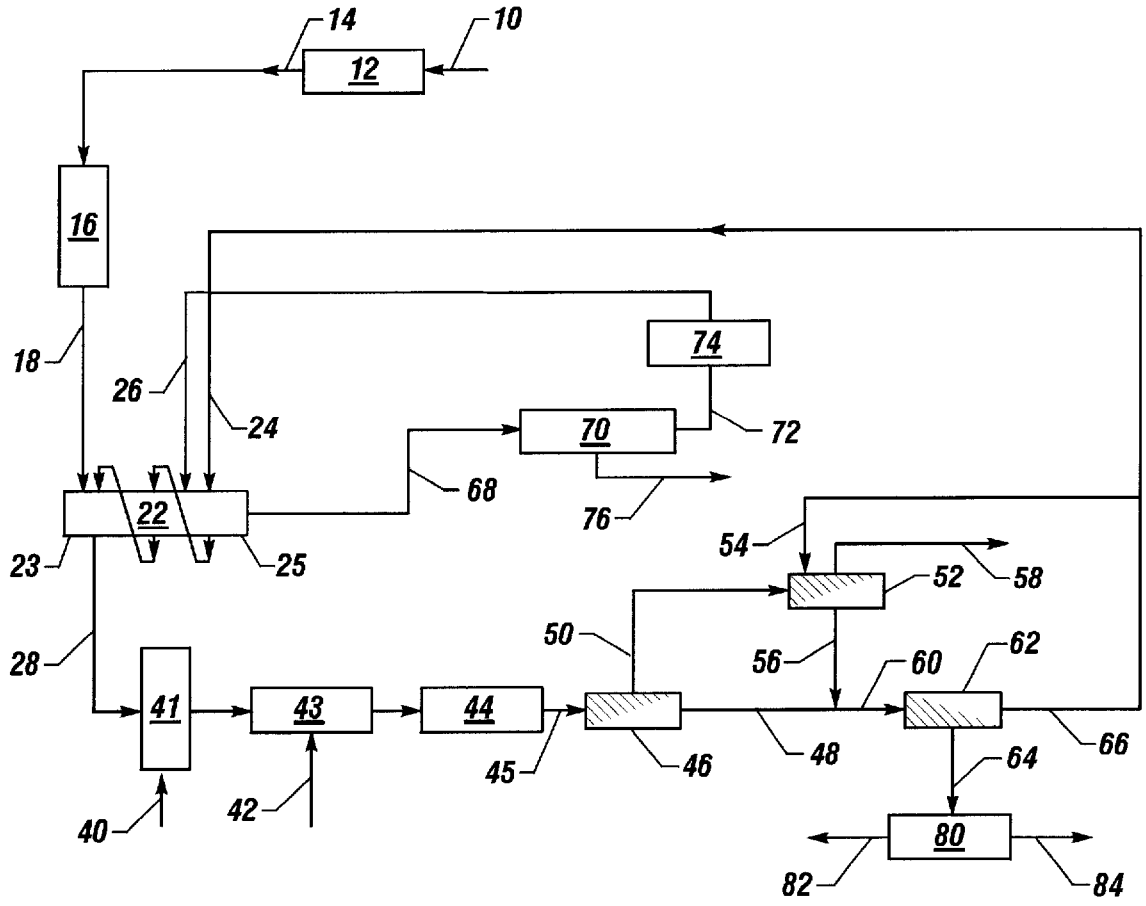
FIG. 1 is a process flow diagram for one embodiment of the present invention.

The present invention provides an improved method for obtaining sucrose from sugar cane. One specific embodiment of the process is described below.

Cane received from the field 10 is sent to a shredder 12 as in a conventional mill process. The pieces of material produced by shredding 14 typically have an average diameter of about ¼ inch and length of 2 to 3 inches. The purpose of this step is to create cane pieces of a relatively uniform size that can be fed to the next step.

The cane pieces 14 are then fed to grinding apparatus 16, which reduces the pieces of cane into pulp 18 that comprises considerably smaller pieces. This grinding can also be described as maceration of the cane pieces. The grinding apparatus is preferably not a roller mill as in a conventional mill process. Instead, the grinding apparatus can suitably be, for example, a hammer mill, pin mill, disc mill, knife mill or the like. Optionally, a plurality of grinding machines can be used in series. To achieve maximum benefit from the present process, it is preferred that the grinding reduce the cane pieces into a pulp that comprises particles having an average fiber length of less than about 10 mm and an average fiber diameter of about 500 microns or less. Most preferably the resulting material is a pulp having an average fiber length less than about 5 mm and an average fiber diameter of about 200 microns or less.

The pulp 18 is fed to a vacuum juice extraction apparatus 22. This apparatus can comprise a horizontal, porous, moving belt that is subjected to a vacuum from the bottom. Cane pulp is introduced as a uniform layer at one end (the feed end) 23 of the belt. A clean water stream 24 is introduced at the opposite or discharge end 25 of the belt. Thus, the macerated cane feed 18 and the water feed 24 to this apparatus 22 are countercurrent to each other. A stream of juice 26 is reintroduced over the belt, preferably at several locations. This method of countercurrent filtration produces a pulp stream 68 with low sugar content and an extracted juice stream 28 with high sugar content. Grinding the cane to smaller particles allows more sucrose to be extracted, increasing the percentage extraction from the bagasse, increasing the yield of the factory. The countercurrent vacuum filtration process preferably is carried out at an elevated temperature of between 65 and 80° C. to control microbial growth and to improve the extraction of juice. A centrifugal or a series of centrifugals may also be used to separate the juice from the macerated cane material. The centrifugal may consist of either a vertical or horizontal rotating perforated basket into which the macerated cane material is introduced and the solid phase and liquid phase are separated across a screen using centrifugal force. Wash water and/or countercurrent extracted juice is sprayed onto the macerated cane material during centrifugation to minimize sugar content in the pulp. Alternatively a screen may be used to separate the juice from the macerated cane material, and water sprayed on to the screen to minimize sugar content in the pulp.

The pulp 68 leaving the juice extractor 22 has a very low sucrose content but a high water content. It is pressed in a screw press or roller press 70 to extract a dilute press juice 72 which contains about 1% dissolved solids and about 99% water. The equipment used for this could be the same as the dewatering mills used in conventional milling. The dewatered pulp (bagasse) 76 can be used as fuel for boilers, as is commonly done in conventional cane mills.

The dilute press juice 72 is raised to a temperature of 65 to 80° C. in a heater 74 and then is returned to the juice extractor 22 as stream 26.

The temperature of the extracted juice 28 is preferably kept somewhere in the range of ambient up to about 80° C., depending on the nature of the impurities that are acceptable and the requirements to eliminate or minimize bacterial action. It is preferred to keep the residence time in the juice separation step or steps as short as practical, to minimize problems caused by enzymatic degradation and microbial action. In some embodiments of the process, this residence time will be less than 10 minutes. This is important because color in cane juice is believed to be created by enzymatic action that starts as soon as the cells in the cane are disrupted. Also sucrose can be degraded to invert at elevated temperatures and times, especially at the pH prevailing in juice when extracted from cane.

The extracted juice 28 is sent to tank 41 and can optionally be sulfitated by the addition of sulfur dioxide, or sulfite or bisulfite salts 40. Preferably a typical level of sulfur dioxide in the juice could be about 3000 ppm. The sulfitation preferably takes place after the juice is separated from the pulp. This sulfitation will prevent the color increase that can otherwise take place during subsequent membrane filtration and evaporation operations. Other antioxidants may also be used.

The extracted juice typically has a slightly acid pH. Therefore it is then adjusted to a pH of at least about 7, more preferably to at least about 7.5 in neutralization tank 43. The presently preferred agents for adjusting the pH are lime or sodium hydroxide, which are preferably added as a slurry or an aqueous stream 42. This pH adjustment helps prevent the inversion of sugars which takes place at elevated temperatures. Other chemicals are also suitable for pH adjustment in this process, e.g. aqueous potassium hydroxide or granular sodium carbonate.

The pH-adjusted juice, which will typically contain about 5–25% by weight solids, is then passed through a heater 44 to increase its temperature to between 65 and 80° C. The heated juice 45 is then filtered through a membrane 46 to separate high molecular weight compounds, particularly color, from sucrose. Nano-, ultra-, or microfiltration membranes can be used, preferably having pore sizes ranging from a molecular weight cutoff of about 500 up to about 0.5 microns. Most preferably the membrane has a molecular weight cutoff between about 1,000–10,000. The membrane filtration produces a permeate 48 which is depleted in impurities, particularly color, relative to the juice, and a retentate 50 that typically contains most of the high molecular weight impurities. Examples of suitable membrane types include ceramic, porous carbon, and polymeric. The membrane filtration preferably takes place at a temperature of between 65 and 80° C.

Preferably the retentate 50 is sent to a second membrane diafiltration step (and optionally also to a third), to recover residual sucrose. The retentate 50 is filtered through a membrane system 52 with addition of water 54. This diafiltration extracts most of the sugar left in the ultrafiltration retentate 50. The diafiltration retentate 58 can be used as an animal feed. The permeate 56 from the diafiltration step and permeate 48 from the primary membrane filtration are combined for further processing.

The combined permeate stream 60 is then concentrated to form a low color syrup, preferably to 60–75° Brix. This can be done using conventional techniques, such as evaporation, 62. Alternatively, a reverse osmosis membrane system 62 can be used for pre-concentration of the purified juice stream, followed by evaporation to the final required brix. Condensate from the evaporator or permeate from the reverse osmosis can be added to the pulp 24 prior to or during centrifugal separation. The evaporated material 64 is a relatively concentrated sucrose solution or syrup.

One or more boiling/crystallization steps 80 are then performed, to crystallize sucrose as in conventional processes. In one embodiment of the process, three such boiling/crystallization steps are used, preferably using a fondant made from milled white sugar as seed. The products will be white sugar 82 from the first crystallization. The mother liquor from this first crystallization can be crystallized further, usually twice more and the sugar obtained can either be used directly as a product, or remelted with the feed to the first crystallization. Molasses 84 is the mother liquor from the third boiling.

Some of the equipment used in the process is conventional and well known to persons of ordinary skill in this field, such as evaporators. Suitable equipment for grinding sugar cane into pulp is available from The Fitzpatrick Company. Filtration equipment is available from Pannevis (Holland), centrifugal extraction apparatus is available from Western States Machine Company (Hamilton, Ohio) and Silver-Weibull (Hasslehom, Sweden), and screening equipment is available from DSM. Suitable membrane filtration systems are available from suppliers such as CeraMem Corp. (Waltham, Mass.), Koch Membrane Systems, Inc. (Wilmington, Mass.), and Osmonics, Inc. (Minnetonka, Minn.).

Many variations of the process are possible. Suitable variations include reverse osmosis before membrane filtration, sulfitation after membrane filtration, and sterilization of the cane pieces or pulp by chemical or physical means. Although some lime or $CO_2$ treatment could be included in the process, it is presently preferred to operate the process without the use of carbonation.

Chromatographic separation or treatment with granular carbon could be used for further purification in this process. Chromatographic separation requires juice pretreatment and juice softening. Since the juice from the present process has been passed through membrane filtration then if sodium hydroxide has been added rather than lime for pH adjustment it would be excellent feed to chromatographic separation.

Further membrane filtration steps could be included in the process to separate sucrose from other juice components such as oligosaccharides.

It may be possible to reduce or eliminate the need for pH adjustment and sulfitation when cane of superior quality is being processed. It is also possible to operate various unit operations at somewhat different process parameters than those specified in the above-described embodiment, or in the following examples.

EXAMPLES

In the following Examples 1–5, the sugar cane used in the experiments was harvested about 24 hours before the processing. Top leaf material was removed from the cane stalks. The stalks were also processed through a Fitz mill (a rotating knife mill). This reduced the cane fiber to approximately 1 inch in length. Except as noted below in certain specific examples, the ground cane fiber was then further processed in an Urschel mill (a rotary grinder). This further reduced the material to pieces with a fiber length of approximately 5 mm. Water was added and the material was spun on a centrifuge to expel the juice. The pH of the juice was then adjusted to 7.0 using sodium hydroxide. The pH-adjusted juice was then passed through an ultrafiltration membrane. Samples of each stage of the juice extraction and membrane treatment process were collected for analysis.

Example 1

Approximately 240 pounds of cane was prepared by chopping off the top leaf material and approximately 6 inches of the bottom stalk; the outer leaf material was not removed. The cane stalks were first processed through a Fitz mill as described above, which reduced it to approximately 1 inch average size material. The collected material was then processed through an Urschel mill, which further reduced it to pieces with a fiber length of approximately 5 mm average size. 14 lbs. of the ground cane fiber were placed into a 5 gallon bucket and 8 liters of cold water were added. This was allowed to sit for approximately 15 minutes, then spun on a basket centrifuge. The fiber material was washed while spinning at high speed with an additional 8 liters of water. This wash water was collected and added to the next 14 lbs. of cane fiber. The centrifuging and washing was repeated on each batch of cane fiber, until approximately 35 gallons of juice was obtained.

The expressed juice had RDS (weight % refractive dry substance) of 8.7 and a pH of 5.6. The pH was adjusted by adding 50% NaOH in 10 ml increments as shown in Table 1.

TABLE 1

| NaOH added (ml) | Juice pH |
|---|---|
| 0 | 5.6 |
| 10 | 6.0 |
| 20 | 6.3 |
| 30 | 6.7 |
| 40 | 7.0 |
| 50 | 7.5 |

Membrane Data:
Manufacturer: PCI
Membrane Type: ½ inch Tubular
Model: ES404
MWCO: 4,000
Material: Polyethersulfone
Surface Area: 0.9 $m^2$ Membrane filtration parameters are summarized in Table 2.

TABLE 2

| Permeate (gal) | Flux (ml/min) | Pressure In (psi) | Pressure Out (psi) | Rec. Flow (GPM) | Temp. (° C.) |
|---|---|---|---|---|---|
| 0 | 292 | 129 | 109 | 2.6 | 23 |
| 5 | 308 | 285 | 267 | 2.6 | 24 |

"Rec. Flow" refers to recirculation flow rate.

The approximate color of the feed material after pH adjustment was 14,587 ICUMSA (RDS=8.2). The approximate color of the permeate was 1,483 ICUMSA (RDS=7.0). Five gallons of permeate were collected.

Example 2

In this test a spiral membrane was used rather than a tubular membrane. The juice fed to the membrane was the same as in Example 1.

Membrane Data:
Manufacturer: DESAL
Membrane Type: Spiral
Model: GK3840C1103
MWCO: 3,500
Feed Spacer: 45 mil
Surface Area: 6 $m^2$

TABLE 3

| Permeate (gal) | Flux (ml/min) | Pressure In (psi) | Pressure Out (psi) | Rec. Flow (GPM) | Temp. (° C.) |
|---|---|---|---|---|---|
| 5 | 1848 | 215 | 201 | 17.2 | 27 |
| 10 | 1940 | 260 | 240 | 23.5 | 29 |
| 20 | 960 | 200 | 183 | 23.3 | 34 |
| 30 | 520 | 192 | 173 | 23.3 | 29 |

The approximate color of the permeate at the end of the run was 742 ICUMSA (RDS=10.3). The approximate color of the retentate at the end of the run was 26,228 ICUMSA. Approximately 30 gallons of permeate were collected.

Example 3

This trial was intended as a control. In this trial, the cane was only chopped coarsely with the Fitz mill, producing a cane fiber that should be representative of the standard cane milling process.

Approximately 160 pounds of cane were prepared by chopping off the top leaf material; outer leaf material was not removed. The cane was processed through a Fitz mill, which reduced it to approximately 1 inch length fiber material. 14 lbs. of the coarse ground cane fiber were placed into a 5 gallon bucket and 8 liters of cold water was added. This was allowed to sit for approximately 15 minutes, then spun on a basket centrifuge. The fiber material was washed while spinning at high speed with an additional 8 liters of water. This wash water was collected and added to the next 14 lbs. of cane fiber. The centrifuging and washing was repeated on each batch of cane fiber until approximately 20 gallons of juice was obtained.

The expressed juice had a RDS of 7.0 and a pH of 5.7. Five ml of 50% NaOH was added to bring the pH to 7.0.

Membrane Data:

Manufacturer: KOCH

Membrane Type: Spiral

Model: HFK131

MWCO: 10,000

Feed Spacer: 80 mil

Material: Polyethersulfone

Surface Area: 4 $m^2$

Membrane filtration parameters are summarized in Table 4.

TABLE 4

| Permeate (gal) | Flux (ml/min) | Pressure In (psi) | Pressure Out (psi) | Rec. Flow (GPM) | Temp. (° C.) |
|---|---|---|---|---|---|
| 0 | 3480 | 100 | 90 | 44 | 26 |
| 15 | 3600 | 285 | 105 | 93 | 38 |

The approximate color of the feed material after pH adjustment was 11,416 ICUMSA (RDS=4.4). The approximate color of the permeate was 1,505 ICUMSA (RDS=4.3). Approximately 15 gallons of permeate were collected.

Example 4

In this trial, the cane was chopped coarsely with the Fitz mill as in the control run (Example 3), then further processed through an Urschel mill to reduce the fiber length to approximately 5 mm.

Approximately 160 pounds of cane was prepared by chopping off the top leaf material; outer leaf material was not removed. The cane was processed through a Fitz mill, which reduced it to approximately 1 inch fiber length. The collected material was then processed through an Urschel mill, which further reduced it to approximately 5 mm fiber length material. 14 lbs. of the coarse ground cane fiber were placed into a 5 gallon bucket and 8 liters of cold water were added. This was allowed to set for approximately 15 minutes, then spun on a basket centrifuge. The fiber material was washed while spinning at high speed with an additional 8 liters of water. This wash water was collected and added to the next 14 lbs. of cane fiber. The centrifuging and washing was repeated on each batch of fiber until approximately 20 gallons of juice was obtained.

The expressed juice had a RDS of 9.1 and a pH of 5.6. 18 ml of 50% NaOH was added to bring the pH to 7.0.

Membrane Data:

Manufacturer: KOCH

Membrane Type: Spiral

Model: HFK131

MWCO: 10,000

Feed Spacer: 80 mil

Material: Polyethersulfone

Surface Area: 4 $m^2$

Membrane filtration parameters are summarized in Table 5.

TABLE 5

| Permeate (gal) | Flux (ml/min) | Pressure In (psi) | Pressure Out (psi) | Rec. Flow (GPM) | Temp. (° C.) |
|---|---|---|---|---|---|
| 0 | 2850 | 102 | 87 | 44 | 20 |
| 15 | 1980 | 102 | 86 | 44 | 33 |

The approximate color of the feed material after pH adjustment was 11,087 ICUMSA (RDS=8.2). The approximate color of permeate was 1,362 ICUMSA (RDS=7.4). Approximately 15 gallons of permeate were collected.

Example 5

Sulfitation was used in this example in an attempt to further decrease the permeate color. The expressed juice was prepared as in Example 4, however immediately after centrifuging, sodium bisulfite was added to the juice. The sodium bisulfite was added at a ratio of 17 grams of sodium bisulfite to 25 pounds of juice (approximately 3000 ppm of $SO_2$).

The expressed juice had a pH of 5.6 after the sulfite addition. 56 ml of 50% NaOH was added to bring the pH to 7.0.

Membrane Data:

Manufacturer: KOCH

Membrane Type: Spiral

Model: HFK131

MWCO: 10,000

Feed Spacer: 80 mil

Material: Polyethersulfone

Surface Area: 4 $m^2$

Membrane filtration parameters are summarized in Table 6.

TABLE 6

| Permeate (gal) | Flux (ml/min) | Pressure In (psi) | Pressure Out (psi) | Rec. Flow (GPM) | Temp. (° C.) |
|---|---|---|---|---|---|
| 0 | 1920 | 109 | 95 | 43 | 21 |
| 15 | 1500 | 110 | 97 | 43 | 25 |

The approximate color of the feed material after pH adjustment was 8,952 ICUMSA (RDS=8.4). The approximate color of the permeate was 986 ICUMSA (RDS=7.8). Approximately 15 gallons of permeate were collected.

Table 7 below summarizes analytical results for a number of the streams in Examples 1–5.

TABLE 7

| Example | Sample | RDS % | Sucrose % on DS | Glucose % on DS | Fructose % on DS | Color ICUMSA | pH | Ash % by Cond. |
|---|---|---|---|---|---|---|---|---|
| 1 | Feed | 8.2 | 84.81 | 0.74 | 0.68 | 14,587 | 7.6 | 0.09 |
| | Retentate 1 | 8.4 | 85.73 | 0.77 | 0.72 | 14,403 | 7.5 | 0.09 |
| | Permeate 1 | 7.0 | 88.59 | 0.53 | 0.56 | 1,483 | 7.6 | 0.09 |
| 2 | Retentate 1 | 8.9 | 85.09 | 0.81 | 0.67 | 15,317 | 7.6 | 0.10 |
| | Permeate 1 | 4.0 | 89.25 | 0.93 | 0.96 | 523 | 7.7 | 0.07 |
| | Retentate 3 | 17.0 | 81.92 | 0.99 | 0.72 | 20,192 | 7.4 | 0.12 |
| | Permeate 3 | 6.9 | 89.84 | 0.67 | 0.67 | 538 | 7.4 | 0.08 |
| | Retentate 4 | 21.4 | 79.40 | 1.25 | 0.83 | 26,228 | 7.1 | 0.13 |
| | Permeate 4 | 10.3 | 91.33 | 0.50 | 0.44 | 742 | 7.5 | 0.09 |
| 3 | Feed | 4.4 | 88.55 | 0.54 | 0.49 | 11,416 | 7.3 | 0.06 |
| | Permeate 1 | 3.1 | 92.46 | 0.35 | 0.34 | 3,581 | 7.3 | 0.04 |
| | Retentate 2 | 4.5 | 86.78 | 0.74 | 0.49 | 15,272 | 6.9 | 0.06 |
| | Permeate 2 | 3.7 | 90.93 | 0.33 | 0.27 | 1,505 | 7.1 | 0.05 |
| 4 | Feed | 8.2 | 85.61 | 0.71 | 0.51 | 11,087 | 7.1 | 0.09 |
| | Permeate 1 | 4.9 | 91.68 | 0.51 | 0.49 | 1,072 | 7.2 | 0.07 |
| | Retentate 2 | 10.5 | 82.17 | 0.79 | 0.54 | 20,539 | 7.2 | 0.11 |
| | Permeate 2 | 7.4 | 90.15 | 0.44 | 0.37 | 1,362 | 7.3 | 0.08 |
| 5 | Feed | 8.4 | 81.78 | 1.34 | 0.97 | 8,952 | 7.2 | 0.12 |
| | Permeate 1 | 5.8 | 86.77 | 1.13 | 0.95 | 618 | 6.7 | 0.10 |
| | Retentate 2 | 11.3 | 78.48 | 1.72 | 1.12 | 18,344 | 6.9 | 0.14 |
| | Permeate 2 | 7.8 | 87.19 | 0.95 | 0.77 | 986 | 6.6 | 0.11 |

In Table 7, "Feed" refers to the pH-adjusted juice fed to the membrane. The multiple permeates and retentates listed in Table 7 represent different samples collected during the respective runs.

Example 6

Particle Size and Removal of Sucrose

The milling of the cane to finer particles than in conventional cane milling allows more sucrose to be released during subsequent processing, for example by filtering. Some examples of the size of ground particles produced by conventional milling and for experimental trials are shown in Table 8. The analysis was carried out by using randomly sampled material and measuring the longest dimension with a stereoscope.

TABLE 8

| Cane Fiber Length Analysis | |
|---|---|
| Fiber from Conventional Cane Mill | |
| Mean Length | 7.24 mm |
| Range | 2.5–27.00 mm |
| Fiber from Example 3 as control | |
| Mean Length | 12.04 mm |
| Range | 2.00–39 mm |
| Finely Ground Fiber | |
| Mean Length | 4.24 mm |
| Range | 1.5–20 mm |

When cane is ground more finely the sucrose can be more effectively removed. Examples are shown in Table 9.

TABLE 9

| Coarse Fiber: (Control, Example 3) |
|---|
| % Moisture = 66.44 |
| Pol = 2.35 |
| % Sugar on total Sample = 3.67 |

TABLE 9-continued

| Fine Fiber (Example 4) |
|---|
| % Moisture = 74.63 |
| Pol = 0.70 |
| % Sugar on total sample = 1.09 |

"Pol" refers to the sugar in the entrained water in the bagasse fiber.

Example 7

Syrups produced by membrane treatment of chopped cane as described in Examples 1–5 above were laboratory crystallized to assess the behavior of their colors. The syrup characteristics are given in Table 10.

TABLE 10

| Syrup Characteristics | | | |
|---|---|---|---|
| Syrup | Description | pH | Color |
| Example 1 | tubular membrane | 6.3 | 2313 |
| Example 2 | lowest molecular weight cutoff membrane | 6.6 | 1326 |
| Example 3 | coarsely milled only | 5.9 | 2669 |
| Example 4 | | 6.2 | 2177 |
| Example 5 | sulphited before membrane | 6.4 | 1425 |

Each of the syrups was laboratory crystallized. The cane syrups from Examples 1 and 4 were cloudy after evaporation prior to the crystallizations. Some addition of caster sugar was needed while measuring the saturation Brix of the syrups and there was insufficient material in the syrup sample from Example 4 to do a laboratory crystallization so more pure sucrose had to be added to make up the weight required.

The crystallization results are shown in Table 11.

TABLE 11

| Laboratory Crystallization Results | | | | |
|---|---|---|---|---|
| | Massecuite | | Crystal | |
| Syrup | Color | Ash | Color | Ash |
| Example 1 | 2747 | 4.63% | 43.0 | 0.041% |
| Example 2 | 1688 | 4.77% | 21.8 | 0.014% |
| Example 3 | 2705 | 3.15% | 32.2 | 0.005% |
| Example 4 | 2488 | 3.90% | 27.2 | 0.003% |
| Example 5 | 1540 | 5.37% | 9.8 | 0.013% |

The majority of the cane samples gave an affined crystal color less than 35 icu and ash less than 0.15%. Syrup film would increase these values.

The preceding description of specific embodiments of the present invention is not intended to be a complete list of every possible embodiment of the invention. Persons skilled in this field will recognize that modifications can be made to the specific embodiments described here that would be within the scope of the present invention.

What is claimed is:

1. A process for producing white or low color sugar from cane, comprising the steps of:

(a) grinding sugar cane or pieces thereof into pulp, wherein the pulp comprises particles having an average fiber length of less than about 10 millimeters and an average fiber diameter of about 500 microns or less;

(b) mechanically separating juice from the pulp;

(c) membrane filtering the separated juice, producing a retentate and a permeate; and (d) concentrating the permeate and crystallizing sugar therefrom;

wherein the sugar crystallized from the permeate has a color no greater than about 35 icu.

2. The process of claim 1, where the pulp comprises particles having an average fiber length of less than about 5 mm and an average fiber diameter of about 200 microns or less.

3. The process of claim 1, where the mechanical separation of juice from pulp is done by filtration, centrifugation, or screening.

4. The process of claim 3, where water is added to the pulp during or prior to filtration, centrifugation, or screening.

5. The process of claim 1, where the pH of the separated juice is adjusted to at least about 7 prior to membrane filtration.

6. The process of claim 1, where the separated juice is contacted with an agent selected from the group consisting of sulfur dioxide, sulfite salts, bisulfite salts, and mixtures thereof.

7. The process of claim 1, where the membrane filtration is done with an ultrafiltration or nanofiltration membrane.

8. The process of claim 1, where the membrane filtration is done with a membrane having a molecular weight cutoff between about 1,000–10,000.

9. The process of claim 1, where the permeate is concentrated and sucrose is crystallized therefrom.

10. The process of claim 9, where no further purification of the permeate occurs after membrane filtration and prior to crystallization.

11. The process of claim 1, where no lime and no carbon dioxide are contacted with the juice or the permeate.

12. The process of claim 1, wherein the sugar crystallized from the permeate comprises less than 0.15% ash.

13. A process for producing sugar from cane, comprising the steps of:

(a) grinding sugar cane or pieces thereof into pulp that comprises particles having an average length of less than about 5 mm and an average diameter of about 200 microns or less;

(b) adding water to the pulp;

(c) mechanically separating juice from the pulp;

(d) adjusting the pH of the juice to at least about 7.0;

(e) membrane filtering the juice through a membrane having a molecular weight cutoff between about 1,000–10,000, producing a retentate and a permeate; and (f) concentrating the permeate and crystallizing sucrose therefrom.

* * * * *